US006559587B1

(12) United States Patent
Inoue et al.

(10) Patent No.: US 6,559,587 B1
(45) Date of Patent: May 6, 2003

(54) DEFLECTION YOKE WITH TWO-PIECE COIL SEPARATOR BODY AND NECK PORTION WITH MOVEMENT PREVENTION ELEMENTS

(75) Inventors: Tomomi Inoue, Fukushima (JP); Tokuhiro Yoshida, Fukushima (JP); Masayuki Ishii, Fukushima (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/156,624

(22) Filed: Sep. 18, 1998

(30) Foreign Application Priority Data

Sep. 22, 1997 (JP) ..... 9-256311

(51) Int. Cl.[7] ..... H01J 29/70; H01J 29/46

(52) U.S. Cl. ..... 313/440; 313/441

(58) Field of Search ..... 313/440, 441, 313/442; 335/209, 296, 297, 213, 299

(56) References Cited

U.S. PATENT DOCUMENTS 5,204,648 A * 4/1993 Jei ..... 335/210
5,258,734 A * 11/1993 Tamai et al. ..... 335/210
5,432,401 A * 7/1995 Satoh et al. ..... 313/440
5,506,482 A * 4/1996 Teramatsu et al. ..... 313/442
5,696,425 A * 12/1997 Moore ..... 313/440
5,780,963 A * 7/1998 Matsuoka et al. ..... 313/440
5,798,606 A * 8/1998 Koga et al. ..... 313/440
5,811,922 A * 9/1998 Yi ..... 313/440
5,942,845 A * 8/1999 Matsubara ..... 313/440
5,945,779 A * 8/1999 Inoue et al. ..... 313/440
5,952,905 A * 9/1999 Kim et al. ..... 313/440
6,031,345 A * 2/2000 Nakata ..... 313/440

* cited by examiner

*Primary Examiner*—Nimeshkumar D. Patel
*Assistant Examiner*—Mariceli Santiago
(74) *Attorney, Agent, or Firm*—Jay H. Maioli

(57) ABSTRACT

A deflection yoke including a separator for holding a horizontal deflection coil and/or a vertical deflection coil, wherein the separator is formed by a combination of a separator main body formed into an approximately funnel shape similar to the contour of the horizontal deflection coil or the vertical deflection coil, and an approximately cylindrically shaped neck portion, formed separately from the separator main body, for holding the horizontal deflection coil and the vertical deflection coil on a neck of a cathode-ray tube. The deflection yoke is simpler in shape and easier to assemble.

6 Claims, 5 Drawing Sheets

DEFLECTION YOKE WITH TWO-PIECE COIL SEPARATOR BODY AND NECK PORTION WITH MOVEMENT PREVENTION ELEMENTS

BACKGROUND OF THE INVENTION

The present invention relates to a deflection yoke used for a CRT, for example, of a type in which a horizontal deflection coil formed by die winding is arranged. In particular, the present invention relates to a deflection yoke having a separator which is formed by combining a separator main body formed in an approximately funnel shape similar to the contour of a deflection coil with a neck portion for holding the deflection coil on the neck of a cathode-ray tube, to thereby simplify the shape of the separator and also simplify its assembling works.

In a related art deflection yoke described in Page 259 of the Proceedings of the 5th Sony Research Forum '95, as shown in FIG. 1, a deflection coil is held on the neck of a cathode-ray tube via a separator, and various correction coils for correcting deflection magnetic fields and the like are arranged on the separator.

A separator is, for example, injection-molded from a resin into a shape similar to the contour of the cathode-ray tube between a funnel portion and a neck portion, that is, an approximately funnel shape, and a cylindrical shape connected to the approximately funnel shape on its small diameter side.

In a deflection yoke, a horizontal deflection coil wound in, for example, a saddle shape by using a die is arranged inside an approximately funnel portion of a separator, and a vertical deflection coil wound around a core is arranged outside the approximately funnel portion of the separator. Further, in the deflection yoke, a flange is formed at a connection portion between the approximately funnel portion and a cylindrical portion, and correction mechanisms for correcting a convergence characteristic and a terminal board for connecting the correction mechanisms to the deflection coil are arranged on the flange and further on the cylindrical portion. In the deflection yoke, a band is arranged at an end portion of the cylindrical portion. The neck of a cathode-ray tube is inserted into the cylindrical portion, and then the band is fastened to certainly hold the cylindrical portion with the neck of the cathode-ray tube.

In recent years, there has been a tendency to arrange various convergence correction mechanisms on a deflection yoke for improving the convergence characteristic.

The arrangement of the various convergence correction mechanisms on a deflection yoke causes problems that the shape of a separator is correspondingly complicated, and that it takes a lot of time to mount these convergence correction mechanisms and correspondingly it take a lot of time to assemble the deflection yoke.

SUMMARY OF THE INVENTION

An object of the present invention is to provide a deflection yoke capable of simplifying the shape thereof and also simplifying the assembling works therefor.

To achieve the above object, according to the present invention, there is provided a deflection yoke including: a separator for holding a horizontal deflection coil and/or a vertical deflection coil, wherein the separator is formed by a combination of: a separator main body formed into an approximately funnel shape similar to the contour of the horizontal deflection coil or the vertical deflection coil; and an approximately cylindrical shaped neck portion, formed separately from the separator main body, for holding the horizontal deflection coil and the vertical deflection coil on a neck of a cathode-ray tube.

Since the separator is formed by a combination of the separator main body and the neck portion, the separator main body and the neck portion can be separately pre-assembled, accordingly making simple the works of mounting convergence correcting mechanisms and the like. Further, since the separator main body and the neck portion can be separately formed, it is possible to lessen various restricting conditions in design such as the releasing direction of a die or the like, and hence to accordingly simplify the shape of the separator.

DETAILED DESCRIPTION OF THE PREFERRED EMBODIMENT

Figure 1:
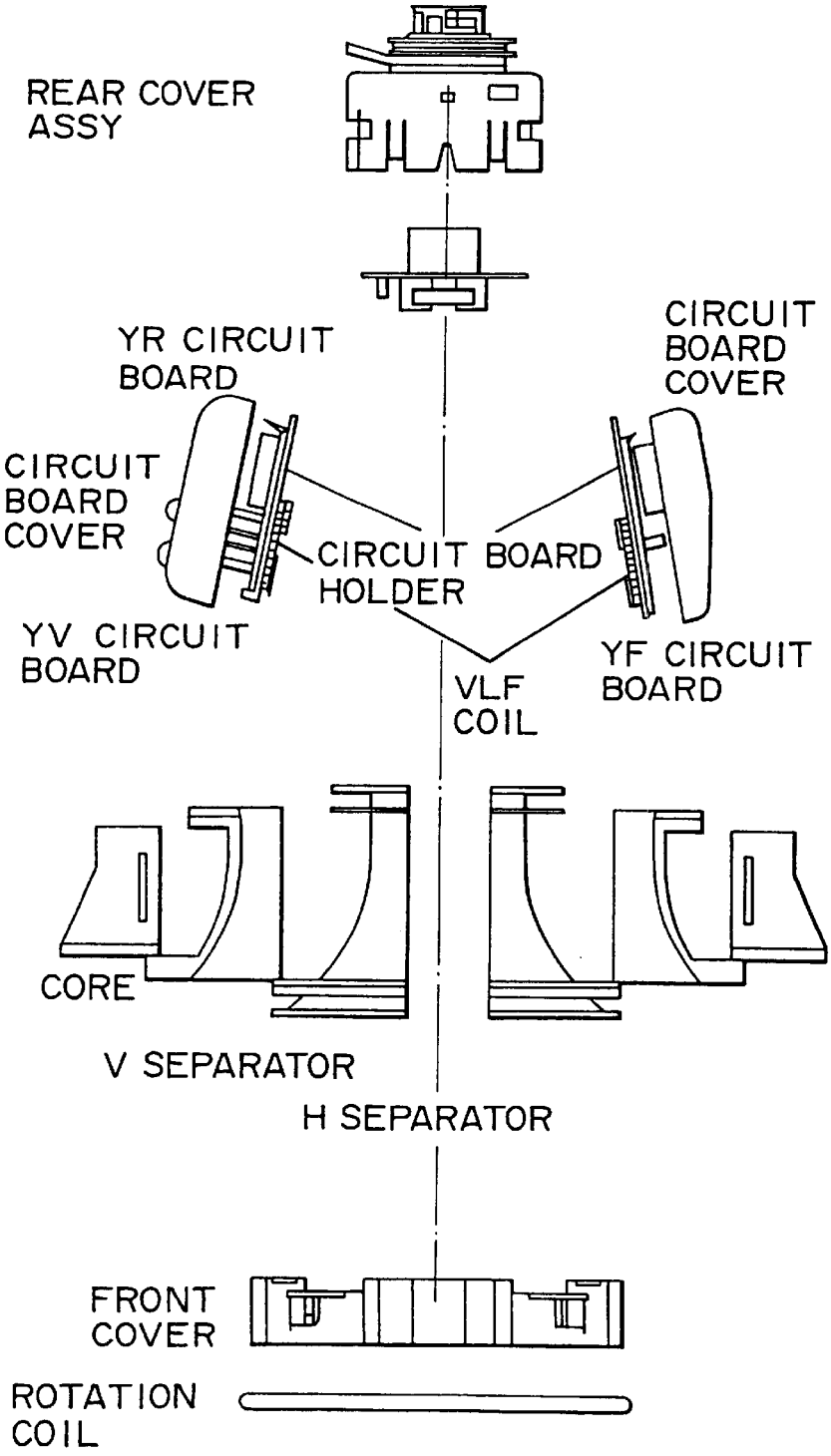
FIG. 1 (PRIOR ART)
FIG. 1 is a view showing a prior art deflection yoke.
Figure 2:
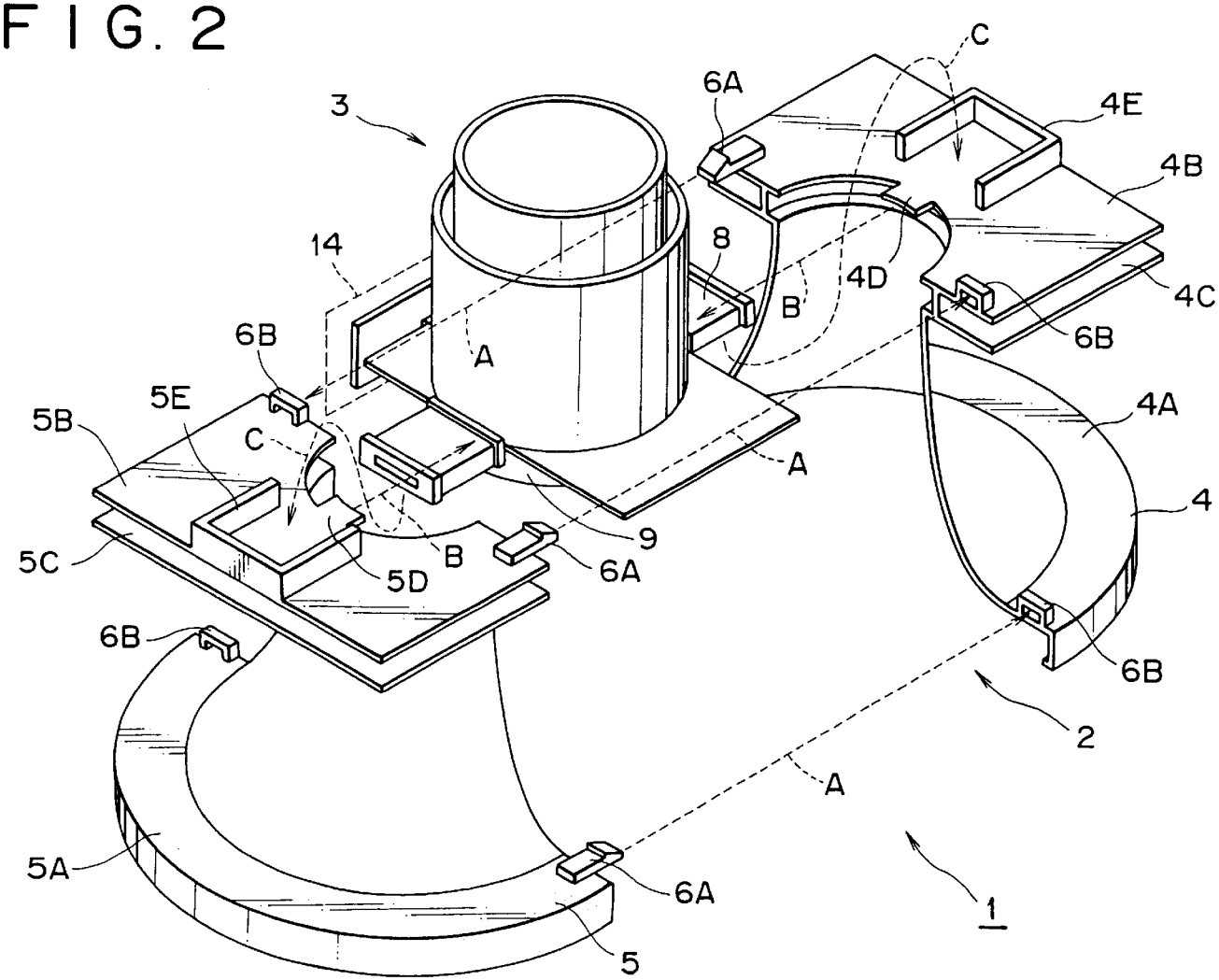
FIG. 2 is an exploded perspective view showing a separator used for a deflection yoke according to an embodiment of the present invention.

FIG. 2 is an exploded perspective view showing a separator used for a deflection yoke according to an embodiment of the present invention. The deflection yoke in this embodiment is of a type in which a pair of horizontal deflection coils wound in a saddle-shape are arranged inside a separator 1 and a vertical deflection coil wound around a core is arranged outside the separator 1.

The separator 1 is prepared by a combination of a separator main body 2 and a neck portion 3. The separator main body 2 is prepared by a combination of a pair of separator main body portions 4 and 5.

The separator main body portions 4 and 5 are injection-molded from a resin into shapes identical with each other, more specifically, equivalent to halves of an approximately funnel shape similar to the contour of both a neck portion and a funnel portion of a cathode-ray tube, divided along a virtual plane containing the tube axis of the cathode ray-tube. The separator main body portions 4 and 5 have circular-arc flanges 4A and 5A at end surfaces on the display screen side and rectangular flanges 4B, 4C and 5B, 5C on the neck side, respectively.

With respect to these separator main body portions 4 and 5, claws 6A and engagement portions 6B into which the claws 6A are to be engaged are oppositely formed on the flanges 4A and 5A on the display screen side and on the outer flanges 4B and 5B on the neck side. By pressingly inserting the claws 6A into openings of the associated engagement portions 6B as shown by an arrow A in FIG. 2, the separator main body portions 4 and 5 are integrated with each other to form the separator main body 2.

The inner sides of the neck side flanges 4B, 4C and 5B, 5C of the separator main body portions 4 and 5 are each curved in a circular-arc shape similar to the contour of the cathode-ray tube. The separator main body portions 4 and 5 hold the neck portion 3 by clamping it with the circular-arc shaped inner end surfaces of the flanges 4B, 4C, and 5B, 5C.

In regard to the outer flanges 4B and 5B of the separator main body portions 4 and 5, approximately central portions of the circular-arc inner end surfaces project inwardly, to form projections 4D and 5D, respectively. The inner end surfaces of the projections 4D and 5D are each formed into a circular-arc shape. The projections 4D and 5D are inserted in openings 9B (which will be described later) of the neck portion 3 as shown by an arrow B in FIG. 2 for preventing the displacement of the neck portion 3.

The neck side surfaces of the flanges 4B and 5B of the separator main body portions 4 and 5 are partially raised and folded to form approximately U-shaped walls 4E and 5E opened toward the center side, respectively. As shown by an arrow C, coils 8 formed on the neck portion 3 are to be inserted in spaces formed in the U-shaped walls 4E and 5E for preventing the turning of the neck portion 3.

Figure 3:
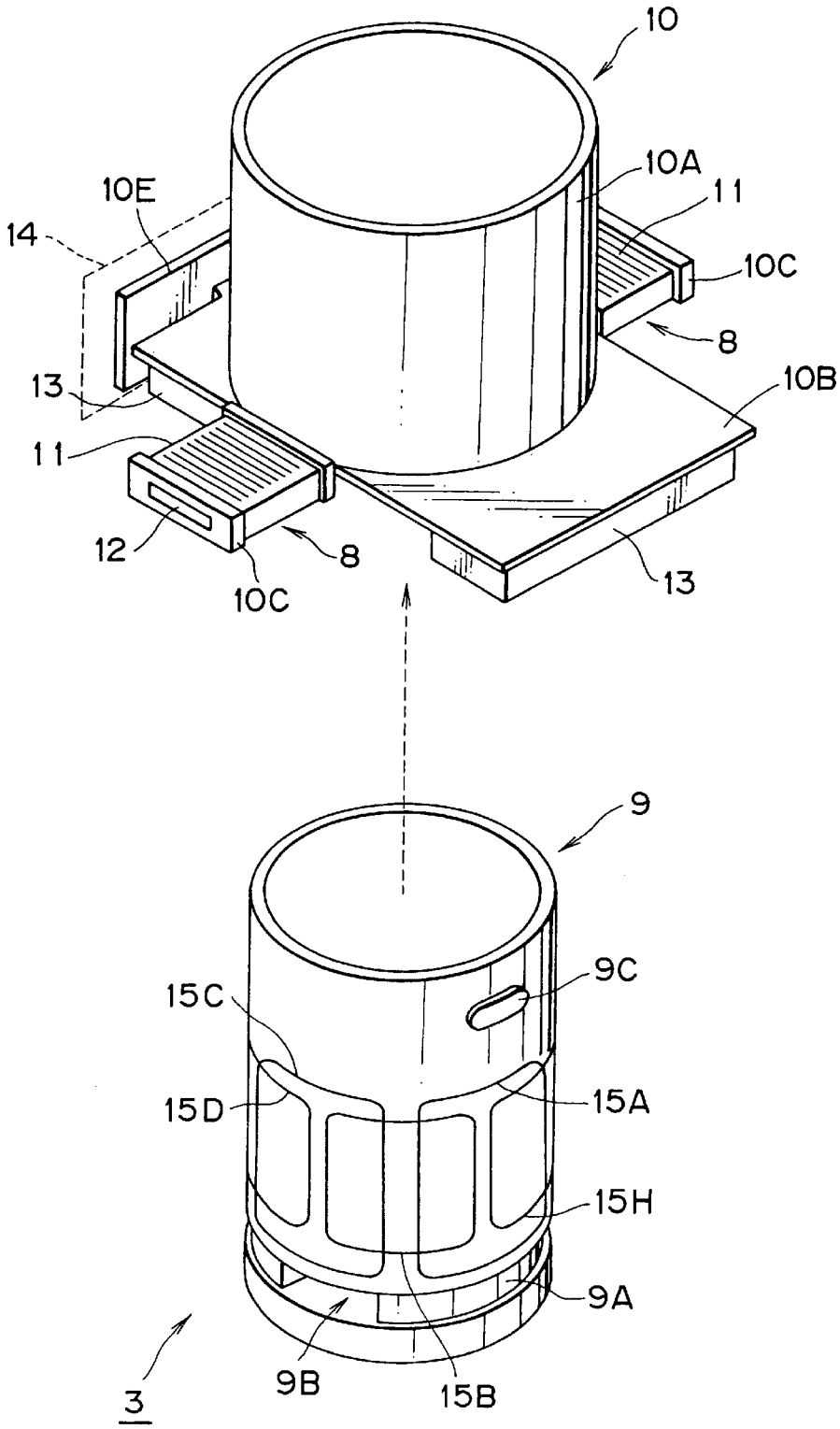
FIG. 3 is an exploded perspective view showing a configuration of a neck portion shown in FIG. 2.

As shown in FIG. 3, the neck portion 3 is composed of a bobbin 9 and a correction coil holding portion 10.

The correction coil holding portion 10, which is injection-molded from a resin, has an approximately cylindrical main body 10A and a rectangular flange 10B arranged on the funnel side. The correction coil holding portion 10 also has a pair of coil bobbins 10C formed in the direction perpendicular to the extending direction of the flange 10B. The main body 10A is formed so as to cover the side surface of the bobbin 9 for preventing coils 15A, 15B, 15C, . . . (which will be described later) wound on the bobbin 9 from being exposed.

Each of the pair of coil bobbins 10C of the correction coil holding portion 10 has a flange for allowing a magnet wire 11 to be wound around the coil bobbin 10C. The coil bobbin 10C also has at its center an opening for holding a core. In a pre-assembly of the correction coil holding portion 10 before being assembled with the bobbin 9, the magnet wires 11 are wound around the pair of coil bobbins 10C to form coils 8 for generating a magnetic field crossing the tube axis of the cathode-ray tube, and the cores 12 are arranged in the openings at the centers of the coil bobbins 10C. The coils 8 are thus allowed to generate the magnetic field for correction of the convergence characteristic, crossing the tube axis of the cathode-ray tube, with a good efficiency.

Figure 4:
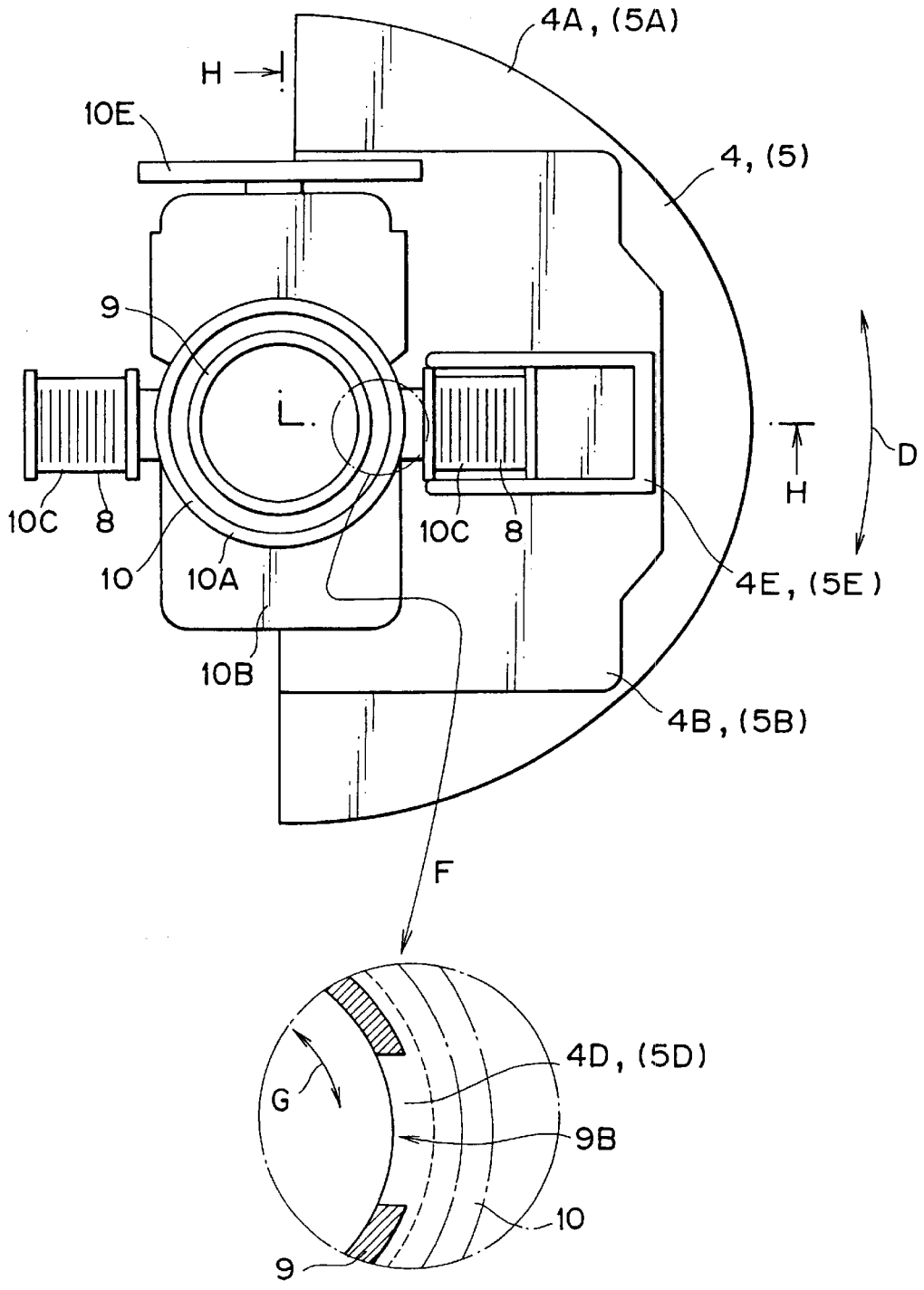
FIG. 4 is a plan view of a separator shown in FIG. 2.

As shown in FIG. 4, when the correction coil holding portion 10 is assembled with the separator main body 2, the flanges of the pair of coil bobbins 10C are clamped in the walls 4E and 5E of the separator main body portions 4 and 5 for preventing the displacement of the correction coil holding portion 10 turned around the tube axis as shown by an arrow D.

The flange 10B of the correction coil holding portion 10 holds other convergence correction coils 13 (see FIG. 3). At this time, the correction coils 13 are held on the surface, on the separator main body 2 side, of the flange 10B of the correction coil holding portion 10, in order that when the neck portion 3 is assembled with the separator main body 2 into a deflection yoke, the correction coils 13 are covered with the flange 10B for preventing the correction coils 13 from being easily touched by an operator.

One end surface of the flange 10B of the correction coil holding portion 10 projects and a rectangular terminal board holding portion 10E is formed at the projecting end of the end surface of the flange 10B. A terminal board 14 is held on the terminal board holding portion 10E.

In the pre-assembly of the correction coil holding portion 10 before being assembled with the bobbin 9, as described above, the magnet wires 11 and the cores 12 are arranged on the coil bobbins 10C to form the coils 8 for correction of the convergence characteristic, then the correction coils 13 are arranged on the flange 10B and the terminal board 14 is arranged on the terminal board holding portion 10E, and the coils 8 and the correction coils 13 are wired to the terminal board 14.

The bobbin 9 has flanges extending in parallel to its center axis, which flanges are arranged on the outer peripheral surface of the bobbin 9 at intervals of a specific angle. Magnet wires are wound on the bobbin 9 using the flanges, whereby a plurality of coils 15A, 15B, 15C, . . . are formed on the bobbin 9. Here, the plurality of coils 15A, 15B, 15C, . . . are formed by sequentially winding the magnet wires on the bobbin 9 at intervals of about 45°. The magnetic fields generated by the coils 15A, 15B, 15C, . . . allows the bobbin 9 to form a magnetic field for correction of the convergence characteristic.

Figure 5:
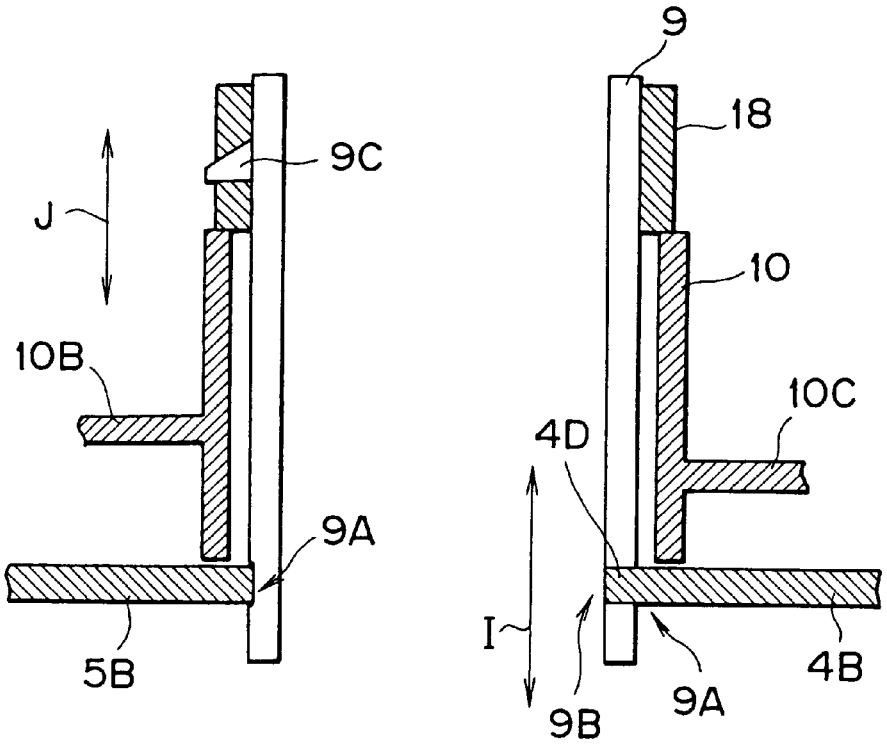
FIG. 5 is a sectional view taken on line H—H of FIG. 4.

The outer periphery, on the separator main body 2 side, of the bobbin 9 is stepwise depressed to form a groove 9A, and rectangular openings 9B are formed in the groove 9A. When the bobbin 9 is assembled with the separator main body 2, as shown by a partial cross-section on a large scale (indicated by an arrow F in FIG. 4), the projections 4D and 5D of the separator main body portions 4 and 5 are inserted in the openings 9B of the bobbin 9 for preventing the turning of the bobbin 9 around the tube axis as shown by an arrow G. As shown in FIG. 5 which is a sectional view taken on line H—H of FIG. 4, by meshing the flanges 4B and 5B of the separator main body portions 4 and 5 with the groove 9A and also inserting the projections 4D and 5D of the separator main body portions 4 and 5 in the openings 9B, the displacement of the bobbin 9 in the direction along the tube axis of the cathode-ray tube, indicated by an arrow I, is prevented.

A projection 9C is formed on the outer side surface, opposite to the groove 9A, of the bobbin 9 (see FIG. 3), and a band 18 for fixing the deflection yoke on the neck of the cathode-ray tube is attached around the bobbin 9 via the projection 9C (see FIG. 5). After the bobbin 9 (see FIG. 3) is integrated with the separator main body portions 4 and 5, the correction coil holding portion 10 and the band 18 are pressedly inserted around the bobbin 9 in sequence. At this time, the displacement of the band 18 in the direction of the tube axis is prevented by the projection 9C, so that the displacement of the correction coil holding portion 10 in the direction along the tube axis as shown by an arrow J is prevented by the band 18 and the flanges 4B and 5B of the separator main body portions 4 and 5.

In the deflection yoke according to this embodiment, the bobbin 9 and the correction coil holding portion 10 pre-assembled in the separate steps are integrated with the separator main body portions 4 and 5 and the horizontal defection coil, and then the vertical defection coil is mounted to the unit thus integrated.

The assembly of the deflection yoke having the above configuration will be described below. First, at the pre-assembly step of the bobbin 9 (see FIG. 3), the magnet wires are wound around the bobbin 9 to form the coils 15A, 15B, 15C, . . . for correction of the convergence characteristic.

At the pre-assembly step of the correction coil holding portion 10, the magnet wires are wound around the coil bobbins 10C to arrange the coils 8 for correction of the convergence characteristic, and the cores 12 are arranged at the centers of the coil bobbins 10C. Further, at the pre-assembly step of the correction coil holding portion 10, the coils 13 for correction of the convergence characteristic are arranged on the surface, on the separator main body 2 side, of the flange 10B, the terminal board 14 is arranged on the terminal board holding portion 10E, and lead wires of these coils 8 and 13 are connected to the terminal board 14. Thus, the pre-assembly of the correction coil holding portion 10 is accomplished.

In the assembly of the deflection yoke of this embodiment, a horizontal deflection coil is wound using a die and a vertical deflection coil is wound around a specific core, separately from the above pre-assembly steps. As shown in FIG. 2, in a state in which the horizontal deflection coil is arranged inside the separator main body portions 4 and 5, the bobbin 9 and the correction coil holding portion 10 are sequentially integrated with the separator main body portions 4 and 5. Thus, the various components pre-assembled are integrated with each other, to form the separator 1.

In this deflection yoke, since the neck portion 3 and the separator main body 2 are separately formed as described above, restricting conditions in design, for example, the releasing direction of a die and the fluidity of a resin, can be relaxed. The configurations of the neck portion 3 and the separator main body portions 4 and 5 can be thus correspondingly simplified, and the productivity in injection-molding can be improved. The period of time required for preparation of a die can be also shortened.

The neck portion 3 can be pre-assembled separately from the separator main body 2, to correspondingly simplify the assembling works of the deflection yoke.

At the step of integrating the neck portion 3 with the separator main body 2, the bobbin 9 is held between the separator main body portions 4 and 5, and the claws 6A and the engagement portions 6B arranged on the flanges 4A, 5A and the like of the separator main body portions 4 and 5 are pressedly engaged with each other. Accordingly, the bobbin 9 can be simply assembled with the separator main body portions 4 and 5.

When the separator main body portions 4 and 5 are integrated with the neck portion 3 while holding it therebetween, the circular-arc portions of the flanges 4B and 5B of the separator main body portions 4 and 5 are meshed with the groove 9A of the bobbin 9 (see FIG. 5) and the projections 4D and 5D formed on the circular-arc portions are engaged with the openings 9B formed in the groove 9A. This makes it possible to prevent the bobbin 9 of the neck portion 3 from turning around the tube axis and the displacement of the bobbin 9 in the direction along the tube axis.

The bobbin 9 is then inserted in the correction coil holding portion 10 to be integrated therewith. The band 18 is attached around the bobbin 9 via the projection 9C, and the lead wires of the coils 15A, 15B, 15C, . . . on the bobbin 9 are connected to the terminal board 14.

At this time, the displacement of the band 18 is prevented by the projection 9C of the bobbin 9, and the displacement of the correction coil holding portion 10 in the direction along the tube axis is prevented by the band 18 and the flanges 4B and 5B of the separator main body portions 4 and 5. The flanges of the coil bobbins 10C formed on the correction coil holding portion 10 are clamped in the U-shaped walls 4E and 5E formed in the separator main body portions 4 and 5, to prevent the turning of the correction coil holding portion 10 around the tube axis.

In the deflection yoke thus assembled, the correction coils 13 are arranged on the surface, on the separator main body 2 side, of the flange 10B (see FIG. 3) and the outsides of the coils 15A, 15B, 15C, . . . are covered with the correction coil holding portion 10, and accordingly, an accident such as erroneous contact of an operator with the coils 13 and the coils 15A, 15B, 15C, . . . can be prevented. Further, since such an accident can be prevented without an additional protective mechanism using such a cover, heat radiation from the coils 13 and the coils 15A, 15B, 15C, . . . is improved.

With this configuration, the separator main body formed into the approximately funnel shape similar to the contour of the horizontal deflection coil is formed separately from the approximately cylindrical neck portion for holding the horizontal deflection coil and the vertical deflection coil on the neck of the cathode-ray tube, and the separator main body and the neck portion are assembled with each other, to form the separator. Accordingly it is possible to relax the restricting conditions in design, for example, the releasing direction of a die and the fluidity of a resin and thereby simplify the configurations of the neck portion and the separator main body, and also to improve the productivity in injection-molding and shorten the period of time for preparation of a die. Since the neck portion can be pre-assembled separately from the separator main body, the assembling works of the deflection yoke can be correspondingly simplified. A neck portion different in shape depending on the kind of the deflection yoke can be assembled with the separator main body according to this embodiment, and also a neck portion having the coils 15A, 15B, 15C, . . . different in characteristic can be assembled with the separator main body of this embodiment. As a result, it is possible to produce a larger number of types deflection yokes using a smaller number of dies. In addition, since the combination of the neck portion and the separator main body can be changed, it is possible to improve the design efficiency.

In this embodiment, the separator main body is composed of the separator main body portions divided along a virtual plane containing the tube axis of the cathode-ray tube and the neck portion is held between the separator main body portions to form the separator, and consequently, the deflection yoke can be simply assembled.

The displacement of the bobbin 9 can be prevented by a restricting mechanism due to engagement of the projections 4D and 5D of the separator main body portions 4 and 5 with the openings 9B of the bobbin 9 and another restricting mechanism due to meshing of the circular-arc portions of the flanges 4B and 5B of the separator main body portions 4 and 5 with the groove 9A of the bobbin 9. As a result, a change with elapsed time and a variation in convergence characteristic and the like can be reduced irrespective of the simple assembling configuration in which the neck portion and the separator main body separately formed are assembled.

The displacement of the correction coil holding portion 10 can be prevented by a restricting mechanism due to holding of the correction coil holding portion 10 from the upper and lower sides by the band 18 attached around the bobbin 9 via the projection 9C and the flanges 4B and 5B of the separator main body portions 4 and 5, and another restricting mechanism due to clamping of the flanges of the coil bobbins 10C formed on the correction coil holding portion 10 in the walls 4E and 5E formed on the flanges 4B and 5B. As a result, a change with elapsed time and a variation in convergence characteristic and the like can be reduced irrespective of the simple assembling configuration in which the neck portion and the separator main body separately formed are assembled.

Since the coils 8 and 13 and the coils 15A, 15B, 15C, . . . for correction of the convergence characteristic are arranged on the neck portion 3, the works for mounting these coils can be performed in the separate steps. This makes it possible to correspondingly simplify the assembling works of the deflection yoke, and hence to shorten the time required for the assembly of the deflection yoke.

In the above arrangement of the coils, by arranging the coils 13 on the surface, on the separator main body 2 side, of the flange 10B and by covering the coils 15A, 15B, 15C, . . . wound on the bobbin 9 with the correction coil holding portion 10, the coils 13 and the coils 15A, 15B, 15C, . . . can be prevented from being exposed. As a result, an accident such. as an operator's erroneous contact with these coils can be effectively prevented and heat radiation from these coils can be improved with a temperature rise of the neck portion reduced.

Since the terminal board 14 is held on the correction coil holding portion 10 and the coils 8 and 13 are wired to the terminal board 14, the wiring works for the coils 8 and 13 can be performed at the pre-assembly step for the correction coil holding portion 10, to correspondingly simplify the assembling works of the deflection yoke.

In the above embodiment, description has been made of the restricting mechanisms, for preventing various displacements, due to engagement of the projections 4D and 5D of the separator main body portions 4 and 5 with the openings 9B of the bobbin 9 and due to meshing of the circular-arc portions of the flanges 4B and 5B of the separator main body portions 4 and 5 with the groove 9A of the bobbin 9. However, the above description is for illustrative purposes only and it is to be understood that various other restricting mechanisms may be widely used as needed.

In the above embodiment, description has been made of the assembling step in which the bobbin 9 is integrated with the separator main body portions 4 and 5 and then the correction coil holding portion 10 is mounted to the unit thus integrated. However, the present invention is not limited thereto. For example, the bobbin 9 may be first integrated with the correction coil holding portion 10 to form the neck portion 3, followed by integration of the neck portion 3 with the separator main body portions 4 and 5.

Also in the above embodiment, description has been made of the configuration in which the neck portion 3 is composed of the bobbin 9 and the correction coil holding portion 10. However, the present invention is not limited thereto. For example, the neck portion may be formed of a single molded part as needed.

Although in the above embodiment, description has been made of a configuration arranging the horizontal deflection coil that prepared by die winding inside the separator, the present invention is not limited thereto but may be widely applied, for example, to a separating winding system employing the horizontal deflection coil is prepared by winding separately, that is the so-called section winding.

In the above embodiment, description has been made of the configuration in which the separator main body is formed into the shape similar to the contour of the horizontal deflection coil prepared by die winding for arranging the horizontal deflection coil inside the separator; however, the present invention is not limited thereto but may be widely applied, for example, to the configuration in which the vertical deflection coil is formed into a saddle shape. Further, a separator in which the saddle-shaped vertical deflection coil is arranged may be composed of a separator main body and a neck portion formed separately from the separator main body. In this case, the separator main body is formed into a shape similar to the contour of the vertical deflection coil.

What is claimed is:

1. A deflection yoke for a cathode-ray tube comprising:

a prewound horizontal deflection coil;

a prewound vertical deflection coil;

a separator for holding one of said prewound horizontal deflection coil and said prewound vertical deflection coil, wherein said separator includes:

a separator main body formed into a substantially funnel shape following a contour of said one of said prewound horizontal deflection coil and said prewound vertical deflection coil;

a substantially cylindrical shaped neck portion formed separately from said separator main body for holding said one of said prewound horizontal deflection coil and said prewound vertical deflection coil on a neck of said cathode-ray tube, wherein said neck portion includes a correction coil holding portion for holding a first plurality of correction coils thereon and a bobbin inserted in said correction coil holding portion for holding a second plurality of correction coils therein; and a restricting mechanism for restricting a displacement of said neck portion relative to said separator main body in a direction along a tube axis of said cathode-ray tube.

2. The deflection yoke according to claim 1, wherein said separator main body includes two portions divided along a plane crossing a tube axis of said cathode-ray tube, and said neck portion is assembled on said separator main body by being held between said two portions.

3. The deflection yoke according to claim 1, wherein said separator main body includes a restricting mechanism for restricting a turning of said neck portion.

4. A deflection yoke for a cathode-ray tube comprising:

a prewound horizontal deflection coil:

a prewound vertical deflection coil;

a separator for holding one of said prewound horizontal deflection coil and said prewound vertical deflection coil, wherein said separator includes:

a separator main body formed into a substantially funnel shape following a contour of said one of said prewound horizontal deflection coil and said prewound vertical deflection coil; and a substantially cylindrical shaped neck portion formed separately from said separator main body, for holding said one of said prewound horizontal deflection coil and said prewound vertical deflection coil on a neck of said cathode-ray tube, wherein said neck portion includes a flange for holding a first plurality of magnetic field correction mechanisms for correcting deflection magnetic fields formed by said one of said prewound horizontal deflection coil and said prewound vertical deflection coil and a bobbin inserted in said flange for holding a second plurality of magnetic field correction mechanism therein, and wherein said separator main body further comprises a second flange on a surface adjacent said neck portion, said second flange including upraised walls for limiting rotation of said neck portion and for limiting displacement of said first plurality of magnetic field correction mechanism about an axis of said cathode-ray tube.

5. The deflection yoke according to claim 4, wherein said second flange is substantially perpendicular to a plane crossing the axis of said cathode-ray tube and said second flange holds one of said first plurality of magnetic field correction mechanisms on a surface adjacent to said separator main body.

6. The deflection yoke according to claim 4, wherein the neck portion holds a terminal board to which lead wires of said first and said second plurality of magnetic field correction mechanisms are connected thereto.

* * * * *